US007314195B2

(12) United States Patent
Takeda et al.

(10) Patent No.: US 7,314,195 B2
(45) Date of Patent: Jan. 1, 2008

(54) WINDING DEVICE FOR WIRE MATERIAL WITH RECTANGULAR SECTION

(75) Inventors: Kyoji Takeda, Tokyo (JP); Yoshihide Goto, Yamagata (JP)

(73) Assignees: Tanaka Seiki Co., Ltd., Tokyo (JP); Goto Denshi Co., Ltd., Yamagata (JP)

( * ) Notice: Subject to any disclaimer, the term of this patent is extended or adjusted under 35 U.S.C. 154(b) by 375 days.

(21) Appl. No.: 10/525,354

(22) PCT Filed: Jul. 22, 2003

(86) PCT No.: PCT/JP03/09242

§ 371 (c)(1),
(2), (4) Date: Feb. 23, 2005

(87) PCT Pub. No.: WO2004/021377

PCT Pub. Date: Mar. 11, 2004

(65) Prior Publication Data

US 2005/0242227 A1 Nov. 3, 2005

(30) Foreign Application Priority Data

Aug. 28, 2002 (JP) ..... 2002-248216

(51) Int. Cl.
*B65H 81/06* (2006.01)

(52) U.S. Cl. ..... 242/445.1

(58) Field of Classification Search ..... 242/443, 242/445.1, 447, 447.1, 448
See application file for complete search history.

(56) References Cited

U.S. PATENT DOCUMENTS 6,007,015 A * 12/1999 Kinutani et al. ..... 242/441.4
6,216,513 B1 * 4/2001 Nakamura et al. ..... 72/148
6,481,089 B1 * 11/2002 Enomoto et al. ..... 29/596
6,553,650 B2 * 4/2003 Nakamura et al. ..... 29/605

FOREIGN PATENT DOCUMENTS

JP 63-195712 U 12/1988

OTHER PUBLICATIONS

First Office Action from the Chinese Patent Office in corresponding Chinese Patent Application 03823634.6 (5 pages—translation; 4 pages).

* cited by examiner

*Primary Examiner*—Emmanuel M Marcelo
(74) *Attorney, Agent, or Firm*—Osha Liang LLP

(57) ABSTRACT

Wire winding is performed while a guide member is regulating a winding position of a regular-square wire (for example, while moving the wire member in an axial direction in accordance with the number of winding (turns) of the rectangular cross section wire member) such that a side surface of the regular-square wire already wound on an outer periphery of a cylindrical part of a bobbin closely adheres to a side surface of the regular-square wire about to be wound. Thus, it is possible to form a coil having an excellent characteristic by winding the regular-square wire on the without making a gap.

7 Claims, 9 Drawing Sheets

WINDING DEVICE FOR WIRE MATERIAL WITH RECTANGULAR SECTION

TECHNICAL FIELD

The present invention relates to a wire-winding technique for winding a rectangular cross section wire member into a coil state.

BACKGROUND ART

In general, a coated copper wire for forming a coil by being wound on a bobbin, etc., often has a circular cross section in a direction orthogonal to the longitudinal direction. In contrast, in recent years, a wire member called a regular-square wire has been developed. The regular-square wire refers to a wire member having a cross section with substantially a horizontal-to-vertical ratio of 1:1, that is to say, having a cross section almost regular square in shape. It is known that a coil having an extremely excellent characteristic can be obtained by winding such a regular-square wire to form a coil.

That is to say, when a conventionally-used wire member having a circular cross section is wound on an outer periphery of a bobbin, a gap inevitably occurs no matter how closely the wire member is wound because of its geometrical shape. In contrast, a regular-square wire can be wound in a plurality of tiers on a bobbin virtually with no gap. Accordingly, the coil space factor of a wire having a circular cross section is about 90.6% at the maximum (that is to say, gaps become 9.4%). In contrast, for a regular-square wire member, a coil space factor of nearly 100% can be obtained. Thus, in order to obtain the same magnetic field by turning on electricity of the same current, it is possible to make the volume of a coil smaller.

Furthermore, in the case of a coil formed by winding a wire having a circular cross section, as is apparent from the above-described space factor, since a heat-insulating air layer occupies about 10% in cross-sectional area ratio of the tiered wire, the thermal conductivity from the inside of the coil is low. Thus, there is a problem in that the maximum current that can be supplied is limited by the heat-generation value of the coil. In contrast, in the case of a regular-square wire, the side surfaces of the adjacent wire member are closely adhered with each other at winding time, and thus an air layer in the winding wire can be substantially zero. It is therefore possible to maintain high thermal conductivity, and thus there is an advantage in that the electric current supplied can be increased. Accordingly, it becomes possible to reduce the volume of a coil to obtain the same magnetic field.

Incidentally, in order to make the most of the characteristic of a wire member having a rectangular cross section such as the regular-square wire described above, the wire member needs to be wound on the outer periphery surface of the bobbin with no gap therebetween. In a conventional wire-winding apparatus, the winding of a wire has been possible without requiring an accurate guide in particular, because the apparatus winds the wire member having a circular cross section. However, in the case of a wire member such as a regular-square wire, when winding is performed by the conventional wire-winding apparatus at a high speed, a side surface of the wire member wound on the outer periphery of the bobbin and the opposed side surface of the wire member adjacently wound separate in the axial direction of the bobbin, or twist with each other. Thus, even if the entire length of the cylindrical part of the bobbin is fabricated to meet the width of the wire member and a predetermined turns of winding with high precision, the winding for one tier might be completed without reaching a predetermined number of turns. In such a case, an air layer is formed inside the wound wire, and thus the advantage of the coil using a regular-square wire is lost.

Furthermore, in the case of forming a coil using a regular-square wire, it is a very important problem how to correctly fold back the wire at both ends of the coil. That is to say, when a wire is continuously wound in a plurality of tiers, in order to form a stable coil, it becomes very important whether or not the winding is reliably performed with high precision while suppressing gaps as much as possible when switching from a lower tier to an upper tier. In order to achieve this, it becomes necessary to increase wire-winding precision in each tier and to make the condition at each folding back timing the same as much as possible.

In order to cope with such a problem, a patent document (Japanese Unexamined Patent Application Publication No. 2000-114084) has disclosed a technique in which a wire member is wound on a bobbin while being moved to one side of the flange of the bobbin using an inclined thin film by winding the wire member on a thin film disposed on an outer periphery of the bobbin.

However, according to such a conventional technique, in the case of disposing a thin film on the outer periphery of the bobbin, it is necessary to provide equipment such as a cut-and-hold mechanism dedicated for the tin film. This causes an increase in cost and results in a complicated wire-winding apparatus. Also, there is a problem in that the cost of the thin film is added and the unnecessary thin film remains in the coil as a product to deteriorate the appearance of the product. Furthermore, there is also a problem in that it is difficult to wind the wire in alignment if the wire is not properly disposed at the beginning time of winding a regular-square wire.

DISCLOSURE OF INVENTION

The present invention has been made in view of the problems of these conventional techniques, and it is an object of the present invention to provide a wire-winding apparatus capable of winding a wire member with higher precision when winding the wire member on the outer periphery of the wound part of a bobbin or a bobbin-less winding jig at a high speed.

In order to achieve the above object, a wire-winding apparatus according to the present invention is a wire-winding apparatus for continuously winding a rectangular cross section wire member having a rectangular cross section on a bobbin or a bobbin-less winding jig, the apparatus including:

a drive part for holding and rotating the bobbin or the bobbin-less winding jig; and a guide member for guiding at least one side surface of the rectangular cross section wire member, wherein winding is performed while the guide member regulating a winding position of the rectangular cross section wire member such that a side surface of the rectangular cross section wire member already wound on an outer periphery of a wound portion of the bobbin or the bobbin-less winding jig closely adheres to a side surface of the rectangular cross section wire member just to be wound.

A wire-winding apparatus according to the present invention is also a wire-winding apparatus for continuously winding a rectangular cross section wire member on a bobbin or a bobbin-less winding jig, the apparatus including:

a rotational drive part for holding and rotating the bobbin or the bobbin-less winding jig; and an axial-direction drive part for independently moving at least two driven members in an axial direction of the bobbin or the bobbin-less winding jig in synchronism with the rotation of the drive part.

A wire-winding apparatus according to the present invention also includes:

first holding means for holding a wire source of a rectangular cross section wire member;

second holding means for holding an end of the rectangular cross section wire member;

a rotational drive part for holding and rotating the bobbin or the bobbin-less winding jig; and drive means for driving the first holding means and the second holding means, and the bobbin or the bobbin-less winding jig relatively moves with each other while maintaining the direction of the rectangular cross section wire member of the wire source held by the first holding means and the direction of the rectangular cross section wire member of the end held by the second holding means.

According to the wire-winding apparatus of the present invention, there is provided a wire-winding apparatus for continuously winding a rectangular cross section wire member on a bobbin or a bobbin-less winding jig, the apparatus includes a drive part for holding and rotating the bobbin or the bobbin-less winding jig; and a guide member for guiding at least one side surface of the rectangular cross section wire member; wherein winding is performed while the guide member regulating a winding position of the rectangular cross section wire member such that a side surface of the rectangular cross section wire member already wound on an outer periphery of a wound portion of the bobbin or the bobbin-less winding jig (note that in the case of the second tier and after, an outer periphery of the rectangular cross section wire member already wound) closely adheres to a side surface of the rectangular cross section wire member about to be wound. Thus, for example, it is possible to form a coil having an excellent characteristic by winding a rectangular cross section wire member such as a regular-square wire having a rectangular cross section on the bobbin or the bobbin-less winding jig without making a gap. However, the wire-winding apparatus of the present invention is effective also in the case of a circular wire particularly when winding a first-tiered wire. In this regard, a rectangular cross section (which means a cross section orthogonal to the axial direction of the wire member is rectangular) does not necessarily refer to a regular-square cross section, but refers to a cross section having an arbitrary horizontal-to-vertical ratio and includes a shape having corners rounded off. Also, a "bobbin-less winding jig" means a jig which is separated from the wound wire after winding a wire on the outer periphery of the wound part in order to form a bobbin-less winding wire.

Furthermore, when the guide member relatively moves in the axial direction of the bobbin or the bobbin-less winding jig in accordance with the rotation of the bobbin or the bobbin-less winding jig, it is possible to regulate the winding position of the rectangular cross section wire member with high precision.

Furthermore, the bobbin or the bobbin-less winding jig has a flange portion at least at one end of the winding portion, and the guide member suspends regulating (guiding, in other words) the rectangular cross section wire member when the rectangular cross section wire member wound on an outer periphery of the wound portion of the bobbin or the bobbin-less winding jig comes close to the flange portion. Thus, it is possible to prevent a problem of the guide member from bumping against the flange portion, etc. In such a case, after the guide member suspends regulating the rectangular cross section wire member, the winding position of the rectangular cross section wire member to be wound might become unstable. However, since the regulation is suspended at a position where the remaining winding space of the cylindrical part is as small as possible, and the remaining winding space is always the same, a folding-back point can be reached with a relatively few number of turns (depending on the cross sectional size of the wire) and with the same condition, it is possible to fold back toward a further outer tier stably.

Also, the rectangular cross section wire member is wound in a plurality of tiers on the outer periphery of the wound portion of the bobbin or the bobbin-less winding jig, a side surface of the rectangular cross section wire member wound while being guided by the guide member as a lower tier near the axis center of the bobbin or the bobbin-less winding jig and a side surface of the rectangular cross section wire member wound while being guided by the guide member as an upper tier on an outer periphery of the lower tier are opposed to each other in an axial direction of the bobbin or the bobbin-less winding jig (That is to say, the contact surface of the guide member with the rectangular cross section wire member of a lower tier is opposed to the contact surface of the guide member with the rectangular cross section wire member of an upper tier in the axial direction). Thus, when the winding is continually performed from the lower tier to the upper tier, it becomes possible to wind both tiers of wire with high precision.

Furthermore, the guide member includes: a first guide bar for guiding the rectangular cross section wire member when winding the lower tier; and a second guide bar for guiding the rectangular cross section wire member when winding the upper tier. Thus, when the wire winding is continually performed from the lower tier to the upper tier, it becomes possible to perform smooth winding operation by passing the rectangular cross section wire member from the first guide bar to the second guide bar in cooperation with each other.

Also, the guide member is movable between a guide position for guiding a side surface of the rectangular cross section wire member to be wound on the bobbin or the bobbin-less winding jig and a retreat position outside of the guide position in a radial direction, and the guide member moves from the guide position to the retreat position before a winding direction of the wire changes on the bobbin or the bobbin-less winding jig. Thus, it is allowed for the rectangular cross section wire member to be wound to the position at which the wire member contacts a side surface of the flange of the bobbin, etc.

Furthermore, the guide member is formed by a flexible plate member having a guide part contacting the rectangular cross section wire member and a support part supporting the guide part in a cantilever state, and the guide member bends by receiving a force from the rectangular cross section wire member being guided at the guide position. Thus, for example, by using one piece of plate member as a guide member, at the time of winding the rectangular cross section wire member in one direction, the guide member can be bent by a resistance force at the time of guiding the rectangular cross section wire member. Also, by using the fact that the bending is eliminated when the guide member is moved to the retreat position at guide suspension time, the guide member is moved to the guide position from that position, and thus it is conveniently possible to fold back at the best timing and to capture the rectangular cross section wire member being wound in the other direction to continue guiding the wire member.

Also, the guide member is formed by a flexible plate member having a guide part contacting the rectangular cross section wire member and a support part supporting the guide part in a cantilever state, and a support angle of the support part changes at the time when the rectangular cross section wire member is wound in one direction and at the time when the rectangular cross section wire member is wound in the other direction. Thus, by using one piece of plate member as a guide member, it is conveniently possible to change the support angle of the support member to appropriately guide the wire by inclining the guide member in a resisting direction to a resistance force from the guided rectangular cross section wire member at the time of winding the rectangular cross section wire member in one direction, and by inclining the guide member in a resisting direction to a resistance force from the rectangular cross section wire member at the time of winding the rectangular cross section wire member in the other direction.

Furthermore, the rectangular cross section wire member is guided by one of the surfaces of the guide when the rectangular cross section wire member is wound in one direction, and the rectangular cross section wire member is guided by the other of the surfaces of the guide member when the rectangular cross section wire member is wound in the other direction. Thus, one piece of a plate member is sufficient, and thereby it is possible to simplify the configuration.

Also, it is preferable that the guide member moves in an axial direction in accordance with the rotation of the bobbin or the bobbin-less winding jig.

Furthermore, it is preferable that the bobbin or the bobbin-less winding jig moves in an axial direction in synchronism with the rotation thereof with respect to the guide member.

Also, the guide member moves in a radial direction in accordance with an outside diameter of the rectangular cross section wire member wound on the bobbin or the bobbin-less winding jig. Thus, it is preferable that appropriate guiding can be performed regardless of the wire width.

Also, the bobbin has a terminal and when the rectangular cross section wire member whose one end vicinity is bound to the terminal is bound on an outer periphery surface of the bobbin, the guide member presses the rectangular cross section wire member to a flange of the bobbin. Thus, it is preferable that swelling and protrusion can be restrained when winding a wire member having a high rigidity.

According to the wire-winding apparatus of the present invention, there is provided a wire-winding apparatus for continuously winding a rectangular cross section wire member on a bobbin or a bobbin-less winding jig, the apparatus including: a rotational drive part for holding and rotating the bobbin or the bobbin-less winding jig; and an axial-direction drive part for independently moving at least two driven members in an axial direction of the bobbin or the bobbin-less winding jig in synchronism with the rotation of the drive part. Thus, for example, one axial direction drive part drives the nozzle for supplying the rectangular cross section wire member as the driven member, and another axial direction drive part drives the guide member for guiding the rectangular cross section wire member on the outer periphery of the wound portion of the bobbin or the bobbin-less winding jig as the driven member. This allows the rectangular cross section wire member, which is prone to disarrangement in winding, to appropriately be wound.

Thus, the driven members are preferably guide members for guiding the rectangular cross section wire member to wind on an outer periphery of the wound portion of the bobbin or the bobbin-less winding jig. The axial-direction drive part may independently drive nozzles for supplying two different types of rectangular cross section wire members or more. More specifically, for example, in the case of winding a first rectangular cross section wire member and a second rectangular cross section wire member having different wire widths on one bobbin, a first nozzle for supplying the first rectangular cross section wire member is moved by a first pitch corresponding to the wire width of the first rectangular cross section wire member for each one rotation of the bobbin, and a second nozzle for supplying the second rectangular cross section wire member is moved by a second pitch corresponding to the wire width of the second rectangular cross section wire member for each one rotation of the bobbin. Thus, it becomes possible to appropriately wind rectangular cross section wire members of different types.

Furthermore, the wire-winding apparatus preferably further includes a holding mechanism for holding and cutting the rectangular cross section wire member, and the guide member moves integrally with the holding mechanism.

The wire-winding apparatus according to the present invention includes: first holding means for holding a wire source side of a rectangular cross section wire member; second holding means for holding an end side of the rectangular cross section wire member; a rotational drive part for holding and rotating the bobbin or the bobbin-less winding jig; and drive means for moving the first holding means and the second holding means, and the bobbin or the bobbin-less winding jig relatively with each other while maintaining the direction of the rectangular cross section wire member of the wire source side held by the first holding means and the direction of the rectangular cross section wire member of the end side held by the second holding means. Thus, by maintaining a relationship between the direction of the rectangular cross section wire member of the wire source and the direction of the rectangular cross section wire member of the end part, the wire member can be disposed on a predetermined position of the bobbin or the bobbin-less winding jig in a state in which one side surface of the rectangular cross section wire member is always in a predetermined direction without being twisted. Thereby, it is possible to restrain the disarrangement of the rectangular cross section wire member to achieve regular winding. In this regard, "maintaining a relationship between the direction of the rectangular cross section wire member of the wire source side and the direction of the rectangular cross section wire member of the end side part" means, for example, maintaining a relative angle between the direction of the rectangular cross section wire member of the wire source and the direction of the rectangular cross section wire member of the end part. If such a relative angle is, for example, within the range of ±45°, there is little possibility of causing the winding disarrangement of the rectangular cross section wire member, and the "relationship" is considered to be maintained in that case.

Furthermore, the second holding means performs a binding operation of the rectangular cross section wire member after the first holding means and the second holding means, and the bobbin or the bobbin-less winding jig are relatively moved and at least one side surface of the rectangular cross section wire member is contacted with the bobbin or the bobbin-less winding jig. Thus, it is possible to prevent twisting of the rectangular cross section wire member at winding time.

Furthermore, the drive means may independently move the first holding means and the second holding means or may integrally move them.

Furthermore, the second holding means is preferably a cut-and-hold mechanism.

Furthermore, the first holding means preferably includes a pulley.

BEST MODE FOR CARRYING OUT THE INVENTION

Figure 1:
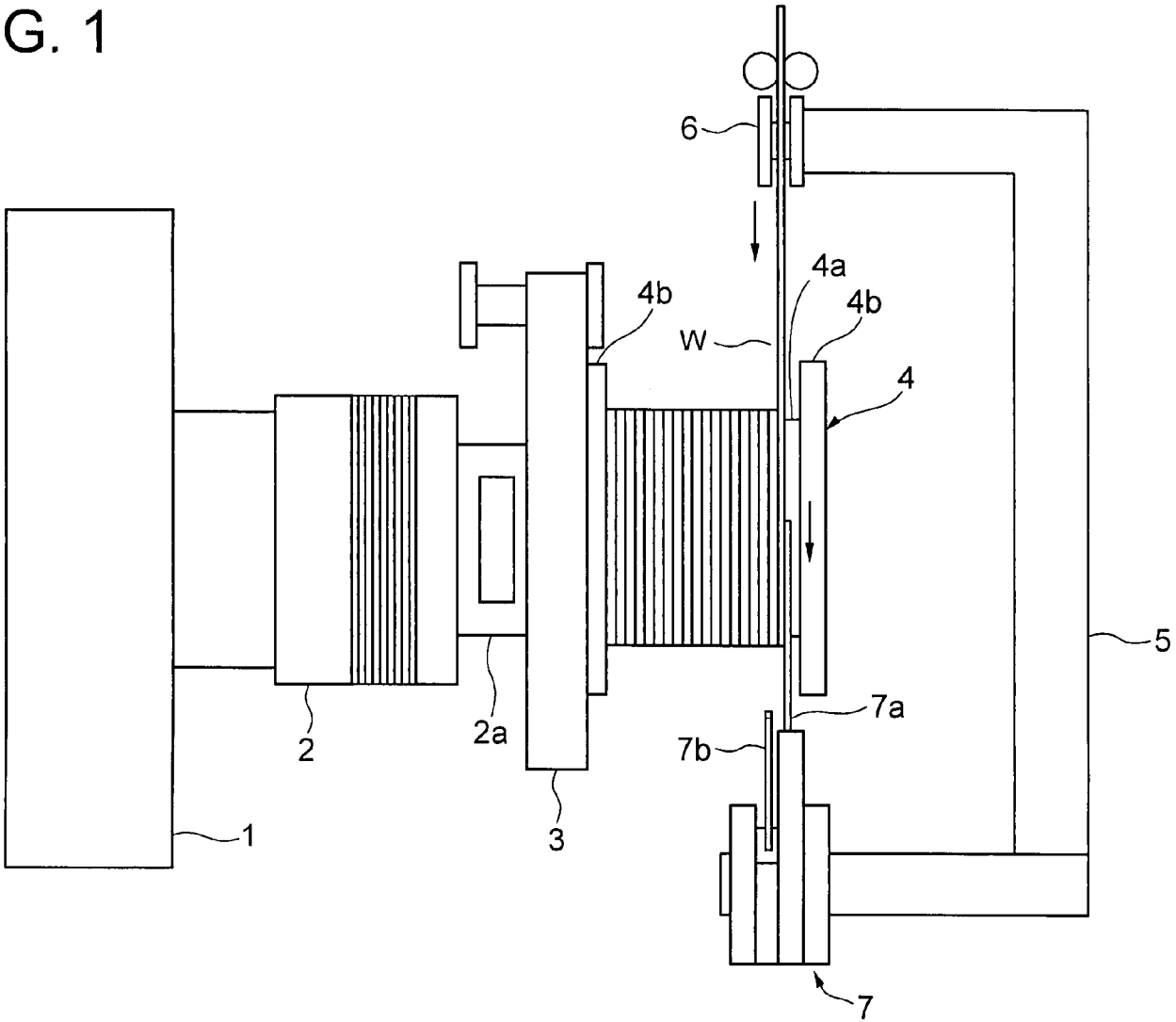
FIG. 1 is a top view illustrating a wire-winding apparatus according to a first embodiment.
Figure 2:
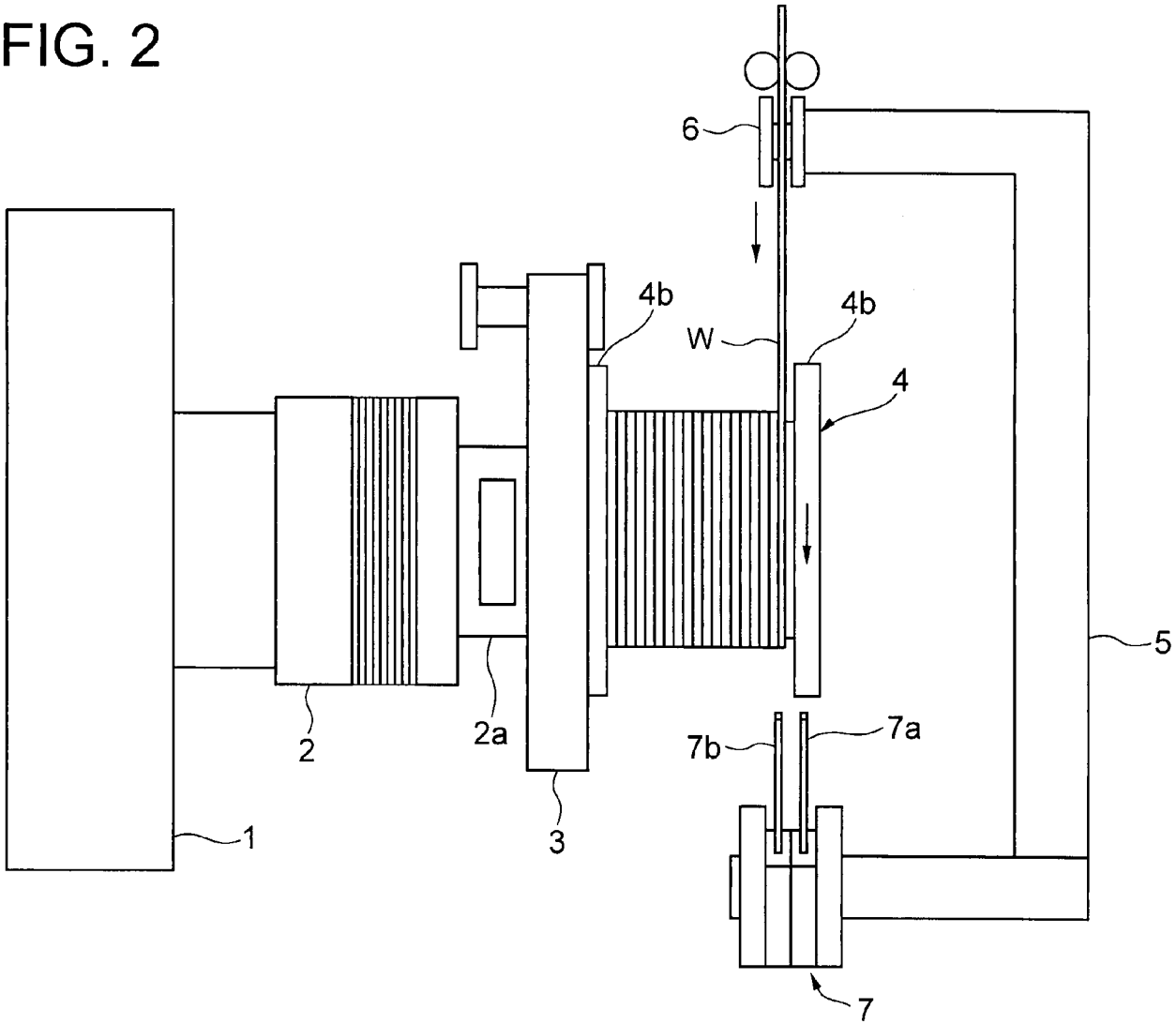
FIG. 2 is a top view illustrating the wire-winding apparatus according to the first embodiment.
Figure 3:
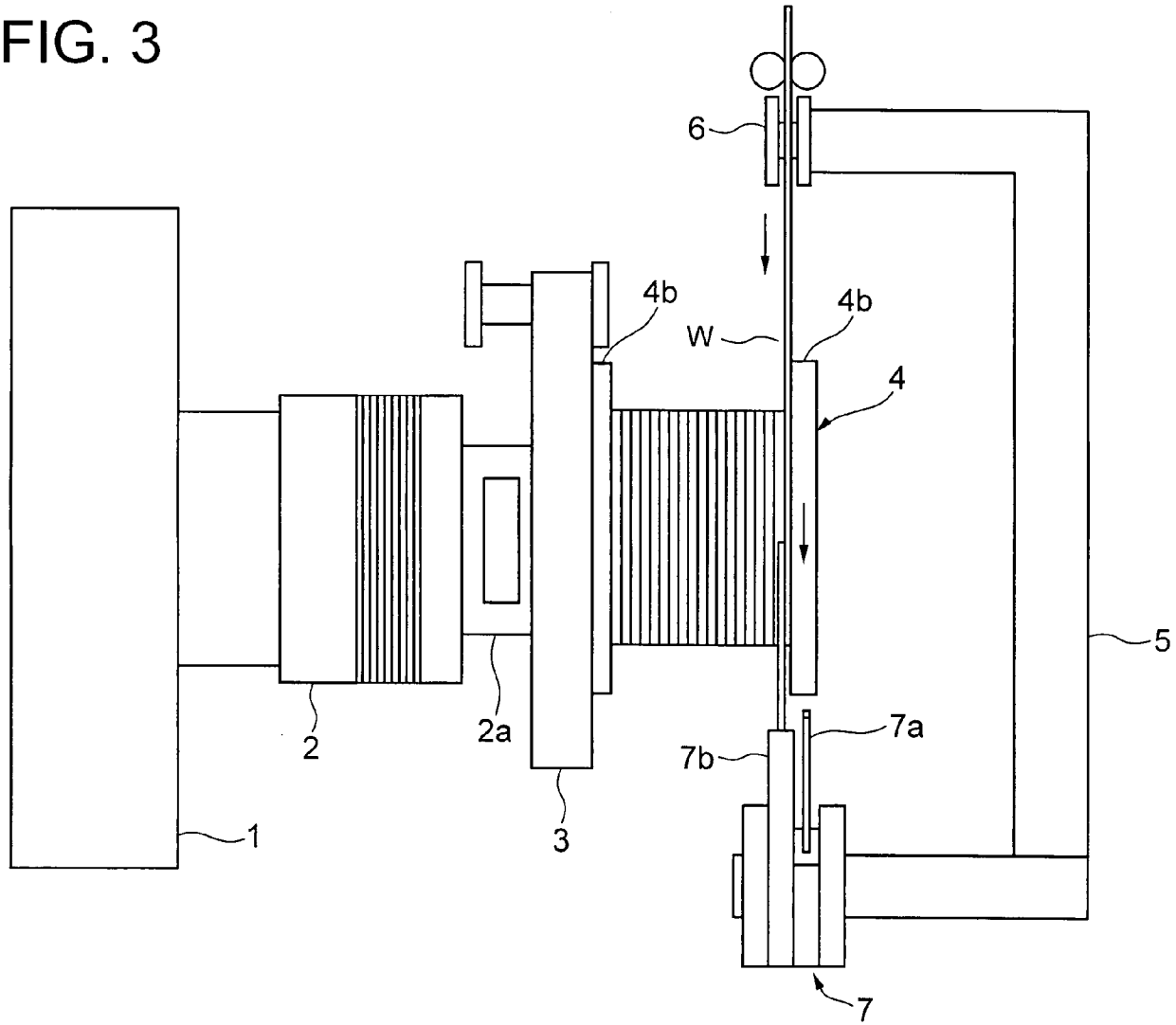
FIG. 3 is a top view illustrating the wire-winding apparatus according to the first embodiment.

In the following, a description will be given of embodiments of the present invention with reference to the drawings. FIGS. 1 to 3 are top views illustrating a wire-winding apparatus according to an embodiment of the present invention. In the figures, a motor 2 is fixed to a first frame 1. A holding part 3 is attached to a rotational shaft 2*a* of the motor 2, which serves as a drive part. The holding part 3 holds a bobbin 4 concentrically with the rotational shaft 2*a*. The bobbin 4 has a cylindrical part 4*a*, which is a wound part, and flange portions 4*b*, 4*b* formed at both ends in an axial direction. In this regard, in the present embodiment, the length of the cylindrical part 4*a* of the bobbin 4 is about six times the width of a regular-square wire W (refer to FIGS. 4A to 4K).

At the same time, in contrast with the first frame 1, a second frame 5 is disposed movably by an unillustrated drive source. A tension pulley 6 for guiding a regular-square wire W, which is a rectangular cross section wire member continuously extending from an unillustrated wire member source is supported by the second frame 5. Also, a guide member 7 including two guide bars 7*a* and 7*b* is attached to the second frame 5. The guide bars 7*a* and 7*b* of the guide member 7 are pivotable by an unillustrated actuator with respect to the second frame 5. By the pivotal movement, the guide bars 7*a* and 7*b* are movable between a guide position (the position of the guide bar 7*a* in FIG. 1 and the position of the guide bar 7*b* in FIG. 3) for guiding the regular-square wire W and a retreat position (the position of the guide bar 7*a* in FIG. 3 and the position of the guide bar 7*b* in FIG. 1) for suspending the guiding.

Next, a description will be given of the operation using the wire-winding apparatus according to the present embodiment. FIGS. 4A to 4K are diagrams illustrating an upper-half sectional view of the bobbin 4, showing the changes of the winding operation with the passage of time. Note that the outer shapes to the regular-square wire W shown in FIGS. 4A to 4K are exaggerated for easy understanding. First, when the winding of the first tier is performed, the guide bar 7*a* is pivoted to the guide position such that the regular-square wire W is positioned on the cylindrical part 4*a* of the bobbin 4 and contacts the side surface of the left flange portion 4*b* in FIGS. 4A to 4K in a state in which an end is fixed to an unillustrated holding device. In these guide positions, the guide bar 7*a* is located in the inside of the radial direction of the flange portions 4*b*, 4*b*, and is kept in a state in which the left side surface thereof contacts the right side surface of the regular-square wire W. In this regard, the lower edge of the guide bar 7*a* may contact the outer periphery surface of the cylindrical part 4*a* of the bobbin 4 or may be apart from the outer periphery surface.

In this state, the motor 2 is driven, and the second frame 5 is further moved rightward in FIG. 1 in accordance with the rotation of the bobbin 4. Thus, the wire-winding operation is performed while the guide bar 7*a* is regulating the position of the regular-square wire W, namely, while guiding the wire such that the side surface of the regular-square wire W already wound on the outer periphery of the cylindrical part 4*a* of the bobbin 4 closely adheres to the side surface of the regular-square wire W about to be wound (refer to FIG. 4A).

Figure 4A:
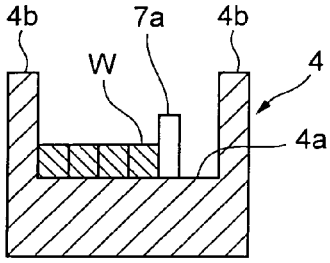
FIGS. 4A to 4K are diagrams illustrating an upper-half sectional view of a bobbin 4 shown together with a regular-square wire.
Figure 4B:
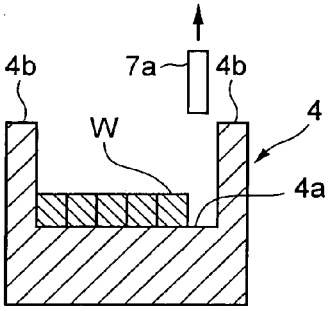

Here, as shown in FIG. 4B, after the regular-square wire W is wound on the outer periphery of the cylindrical part 4*a* of the bobbin 4 five times, the guide bar 7*a* functioning as the first guide bar pivots from the guide position to the retreat position to suspend guiding (Refer to FIG. 2) in order to avoid contacting the right flange portion 4*b*. In such a case, the guiding of the regular-square wire W by the guide bar 7*a* is terminated, and thus the winding position might become unstable. However, when the guide bar 7*a* retreats in a state in which a remaining winding space of the cylindrical part 4*a* is very small, the regular-square wire W is guided with a certain degree of precision between the right side surface of the regular-square wire W already wound on the outer periphery of the cylindrical part 4*a* of the bobbin 4 and the right flange portion 4*b*. Thus, the end of the wiring in the first tier (the lower tier, here) is kept in a state having a very small gap and the folding back toward the outer second tier (the upper tier, here) can be stably performed furthermore (refer to FIG. 4C).

Figure 4C:
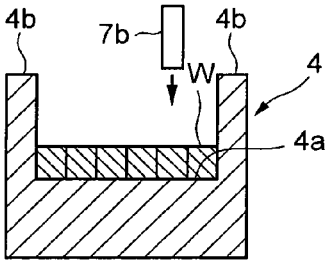
Figure 4D:
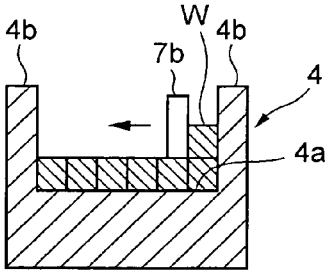
Figure 4E:
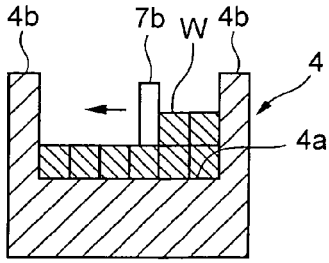
Figure 4F:
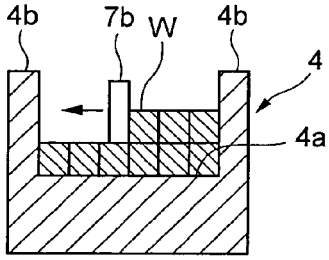
Figure 4G:
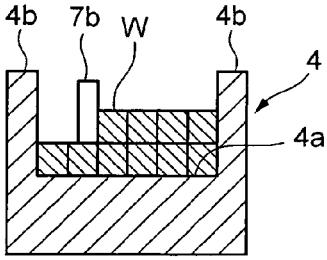

Subsequently, for winding in the second tier, the guide bar 7*b* positioned at the retreat position pivots to the guide position as a second guide bar (refer to FIG. 4C). In such a state, as shown in FIG. 4D, the guide bar 7*b* is located in the inside of the radial direction of the flange portions 4*b*, 4*b*, and is kept in a state in which the right side surface thereof contacts the left side surface of the regular-square wire W (refer to FIG. 3). That is to say, the side surface (right in FIGS. 4A to 4K) of the regular-square wire W wound in the first tier near the axis of the bobbin 4 while being guided by the guide bar 7*a* is opposed to the side surface (left in FIGS. 4A to 4K) of the regular-square wire W wound in the second tier on the outer periphery of the first-tiered winding wire while being guided by the guide bar 7*b* in the axial direction of the bobbin 4. In this regard, the lower edge of the guide bar 7*b* may contact the outer periphery surface of the first-tiered winding wire or may be apart from the outer periphery surface.

In this state, the second frame 5 is moved leftward in FIG. 3 in accordance with the rotation of the bobbin 4. Thus, the wire-winding operation is performed while the guide bar 7*b* is regulating the winding position of the regular-square wire W, namely, while guiding the wire such that the side surface of the regular-square wire W already wound in the second tier closely adheres to the side surface of the regular-square wire W about to be wound (refer to FIGS. 4D to 4G).

Figure 4H:
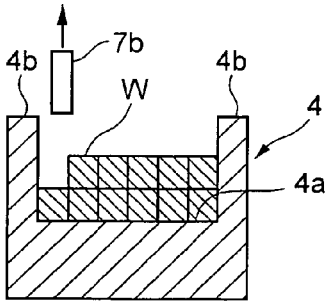

Furthermore, as shown in FIG. 4H, after the regular-square wire W is wound on the outer periphery of the first-tiered winding wire wound on the outer periphery of the cylindrical part 4*a* of the bobbin 4 five times, the guide bar 7*b* functioning as the second guide bar pivots from the guide position to the retreat position to suspend guiding in order to avoid contacting the left flange portion 4*b*. Similarly, the guiding of the regular-square wire W by the guide bar 7*b* is terminated, and thus the winding position might become unstable. However, when the guide bar 7*b* retreats in a state in which a remaining winding space of the second tier is very small, the regular-square wire W is guided with a certain degree of precision between the left side surface of the regular-square wire W already wound on the outer periphery of the first-tiered winding wire and left flange portion 4*b*. Thus, the end of wiring in the second tier (the lower tier, here) is kept in a state having a very small gap and the folding back toward the outer third tier (the upper tier, here) can be stably performed (refer to FIG. 4I).

Figure 4I:
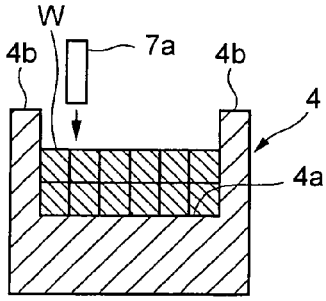
Figure 4J:
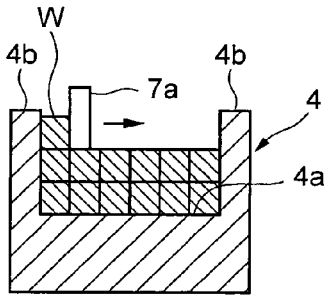
Figure 4K:
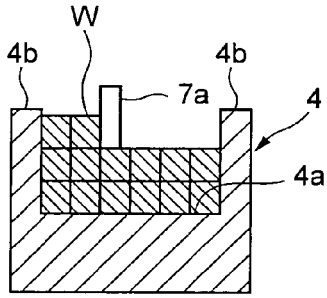

Subsequently, for winding the wire in the third tier, the guide bar 7*a* positioned at the retreat position pivots to the guide position as the first guide bar (refer to FIG. 4I). In such a state, as shown in FIG. 4J, the guide bar 7*a* is kept in a state in which the left side surface thereof contacts the right side surface of the regular-square wire W in the inside of the radial direction of the flange portions 4*b*, 4*b*. That is to say, the side surface (left in FIGS. 4A to 4K) of the regular-square wire W wound in the second tier near the axis of the bobbin while being guided by the guide bar 7*b* is opposed to the side surface (right in FIGS. 4A to 4K) of the regular-square wire W wound in the third tier on the outer periphery of the second-tiered winding wire while being guided by the guide bar 7*a* in the axial direction of the bobbin 4. In this regard, the lower edge of the guide bar 7*a* may contact the outer periphery surface of the second-tiered winding wire or may be apart from the outer periphery surface.

In this state, the second frame 5 is moved rightward in FIG. 1 in accordance with the rotation of the bobbin 4. Thus, the wire-winding operation is performed while the guide bar 7*a* is regulating the position of the regular-square wire W, namely, while guiding the wire such that the side surface of the regular-square wire W already wound in the third tier closely adheres to the side surface of the regular-square wire W about to be wound (refer to FIGS. 4J to 4K). Subsequently, the wire winding is performed in the same manner. After the wire winding is performed up to a predetermined number of tiers, the regular-square wire W is fixed to an unillustrated holding device to be cut, thereby forming a coil.

In this regard, in the case where the flange portion is retreated in the axial direction when the wire winding is performed on the end of the bobbin, it becomes unnecessary to move the guide bar to the retreat position as a matter of course.

Figure 5:
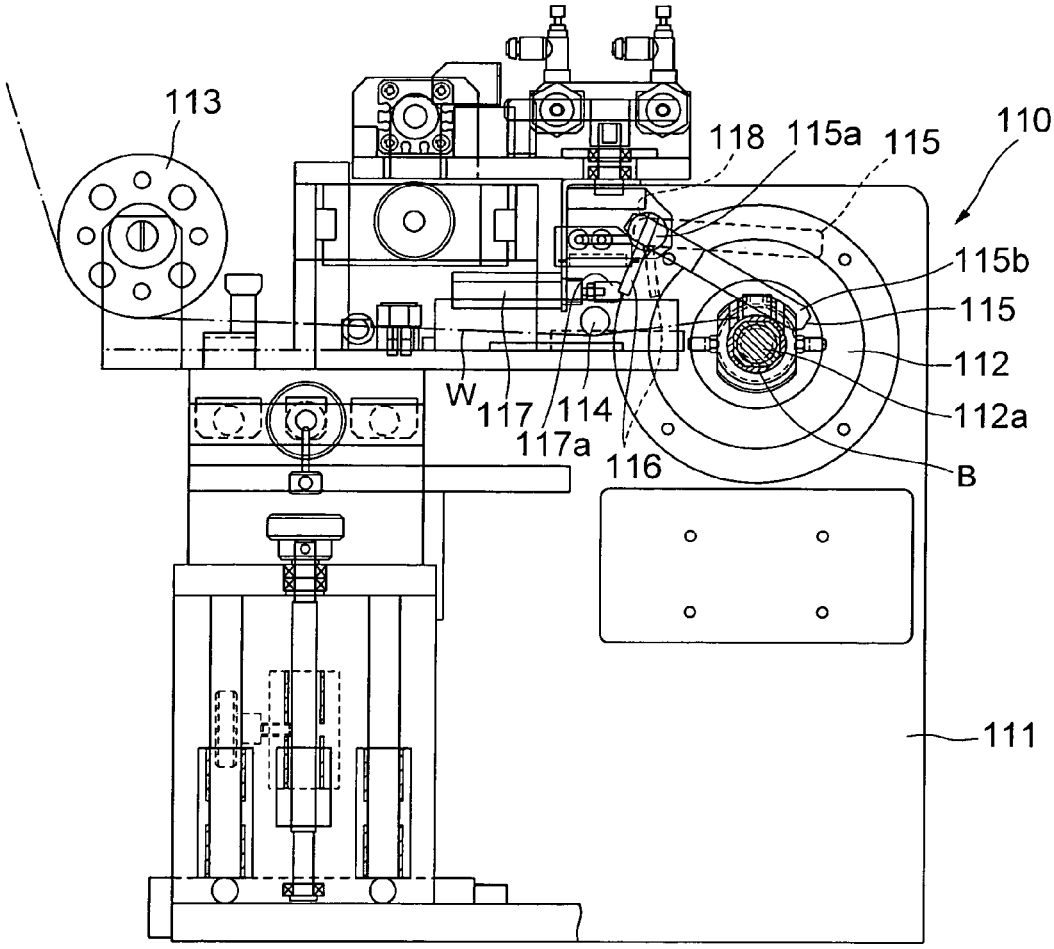
FIG. 5 is a front view illustrating a wire-winding apparatus 110 according to a second embodiment.

FIG. 5 is a front view illustrating a wire-winding apparatus 110 according to a second embodiment. In the figure, a motor 112 installed on an unillustrated stage is attached to a frame 111. The motor 112 has a rotational shaft 112*a* extending in the vertical direction to the page surface. The motor 112 is movable in the axial direction of the rotational shaft 112*a* by an actuator, which is unillustrated moving means, for each installation stage.

A bobbin B is attached to the end of the rotational shaft 112*a*, which is a drive part. A wire member W, which is a regular-square wire, is extending toward the bobbin B through a pulley 113 from the left in FIG. 1. The wire member W passes under a small pulley 114 immediately before the bobbin B, thereby reaching the outer periphery of the bobbin B at a slightly upward angle to the horizontal. In this regard, the wire member W may pass on the small pulley 114, thereby reaching the outer periphery of the bobbin B at a slightly downward angle to the horizontal.

A guide member 115 is disposed above the small pulley 114. The guide member 115 is formed by a flexible plate member made of metal or ceramic. The guide member 115 has a support part 115*a* attached in a swingable relationship with respect to the frame 111 and a guide part 115*b* for guiding the wire member. Also, the guide member 115 fixes a follower bar 116 formed protruding sideward. The follower bar 116 contacts a drive rod 117*a* of an air cylinder 117. The guide member 115 is urged clockwise in the figure by a coil spring 118. That is to say, when the drive rod 117*a* of the air cylinder 117 shrinks, the guide member 115 is urged to the guide position shown by the solid line in the figure by an urging force of the coil spring 118. When the drive rod 117*a* of the air cylinder 117 expands, the guide member 115 is moved to a retreat position shown by the dotted line in the figure by the follower bar 116 being pushed.

Next, a description will be given of the operation using the wire-winding apparatus according to the present embodiment. FIGS. 6A to 6D are diagrams illustrating an upper-half of the cross section of the bobbin B, showing the changes of the winding operation with the passage of time. The bobbin B has a cylindrical outer periphery surface B*a* and a pair of flanges B*b* formed at both ends. The bobbin B may have the flange B*b* only at one end.

First, when the wire winding in the first tier is performed, the guide member 115 is pivoted to the guide position by operating the drive rod 117*a* of the air cylinder 117 (FIG. 5) such that the wire member W is positioned on the outer periphery surface B*a* of the bobbin B and contacts the side surface of the left flange B*b* in FIGS. 6A to 6D in a state in which an end is fixed to an unillustrated holding device. In these guide positions, the guide part 115*b* of the guide member 115 is located in the inside of the radial direction of the flanges B*b*, B*b*, and is kept in a state in which the left side surface thereof contacts the right side surface of the regular-square wire W. At the guide position, the lower edge of the guide member 115 contacts the outer periphery surface Ba of the bobbin B by the urging force of the coil spring 118.

Figure 6A:
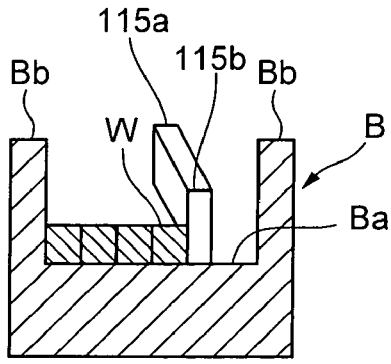
FIGS. 6A to 6D are diagrams illustrating an upper-half sectional view of a bobbin B, showing changes of a winding operation with the passage of time.

In this state, the motor 112 is driven (FIG. 5) to rotate the rotational shaft 112*a* together with the bobbin B, and at the same time, the stage of the motor 112 is moved (moved by a width of the wire member W in the axial direction during one rotation) in synchronism with the rotation of the rotational shaft 112*a*, and thus the bobbin B relatively moves with respect to the guide member 115 in the direction of the arrow in FIG. 6A. At this time, the wire-winding operation is performed while the guide part 115*b* of the guide member 115 is regulating the winding position of the wire member W, namely, while guiding the wire such that the side surface of the regular-square wire W already wound on the outer periphery surface B*a* of the bobbin B closely adheres to the side surface of the wire member W about to be wound (refer to FIG. 6A). Since the guide part 115*b* of the guide member 115 receives a resistance force by the guided wire member W, as shown in the figure, the guide member 115 bends, thereby causing a displacement in the axial direction between the guide part 115*b* and the support part 115*a*.

Figure 6B:
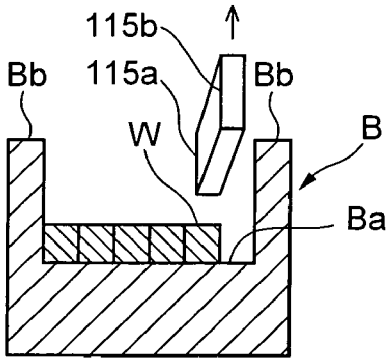
Figure 6C:
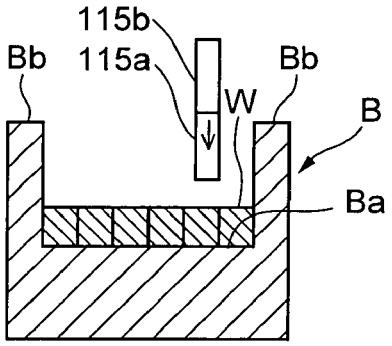

Here, as shown in FIG. 6B, at the stage after the wire member W is wound on the outer periphery surface Ba of the bobbin B a predetermined number of times (five times in figure), the drive rod 117*a* of the air cylinder 117 is operated, and thereby the guide member 115 is moved from the guide position to the retreat position to suspend guiding in order to avoid contacting the right flange B*b*. In such a case, the guiding of the wire member W by the guide member 115 is terminated, and thus the winding position might become unstable. However, the guide member 115 can retreat in a state in which a remaining winding space of the outer periphery surface B*a* is very small, because the guide member 115 is a thin plate member. Accordingly, the wire member W is guided with a certain degree of precision between the right side surface of the wire member W already wound on the outer periphery surface B*a* of the bobbin B and the right flange B*b*. Thus, the end of wiring in the first tier (the lower tier, here) is kept in a state having a very small gap and the folding back toward the outer second tier (the upper tier, here) can be stably performed (refer to FIG. 6C). In this regard, as shown in FIG. 6C, since the guide member 115, which has retreated to the retreat position, receives no resistance force by the guided wire member W, thereby causing no displacement in the axial direction between the guide part 115*b* and the support part 115*a*.

Subsequently, for winding the wire in a second tier, the drive rod 117*a* of the air cylinder 117 is operated, and thereby the guide member 115 positioned at the retreat position is moved to the guide position (refer to FIG. 6C). At the retreat position, the guide member 115 becomes unbent, and thus the axial direction of the guide part 115*b* matches that of the support part 115*a*. Accordingly, it is possible for the right side surface of the guide member 115 to capture the wire member W folded back in the second tier only by directly moving the guide member 115 to the guide position.

Figure 6D:
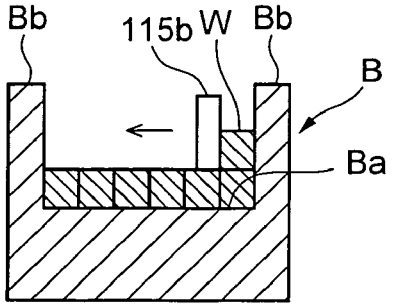

That is to say, as shown in FIG. 6D, the guide member 115 is located in the inside of the radial direction of the flanges B*b*, B*b*, and is kept in a state in which the right side surface thereof contacts the left side surface of the wire member W. Here, the side surface (right in FIGS. 6A to 6D) of the wire member W wound in the first tier near the axis of the bobbin B while being guided by the guide member 115 is opposed to the side surface (left in FIGS. 6A to 6D) of the wire member W wound in the second tier on the outer periphery of the first-tiered winding wire while being guided by the guide member 115 in the axial direction of the bobbin B, and thus one piece of the guide member can perform guiding in both of the winding directions. At the guide position, the lower edge of the guide member 115 contacts the outer periphery surface of the first-tiered winding wire by the urging force of the coil spring 118. That is to say, the guide position of the second tier is moved by the diameter of the wire member W in the radial direction from the first-tier guide position.

In this state, the stage of the motor 112 is moved rightward in FIGS. 6A to 6D in accordance with the rotation of the bobbin B. Thus, the wire-winding operation is performed while the guide member 115 is regulating the winding position of the wire member W, namely, while guiding the wire member such that the side surface of the wire member W already wound in the second tier closely adheres to the side surface of the wire member W about to be wound. In the similar manner, wire winding is performed in the second and the third tiers. After the wire winding is performed up to a predetermined number of tiers, and then the wire member W is fixed to an unillustrated holding apparatus to be cut, thereby forming a coil.

According to the present embodiment, by using the guide member 115, it is possible to use an inexpensive bobbin B having the shape of a simple cylinder and an outer periphery without peripheral grooves. Thus, it becomes possible to wind and align the wire member W on the bobbin B with no gap therebetween and without the necessity of using a thin film in order to produce a coil having good quality in outer appearance and excellent characteristic.

Figure 7A:
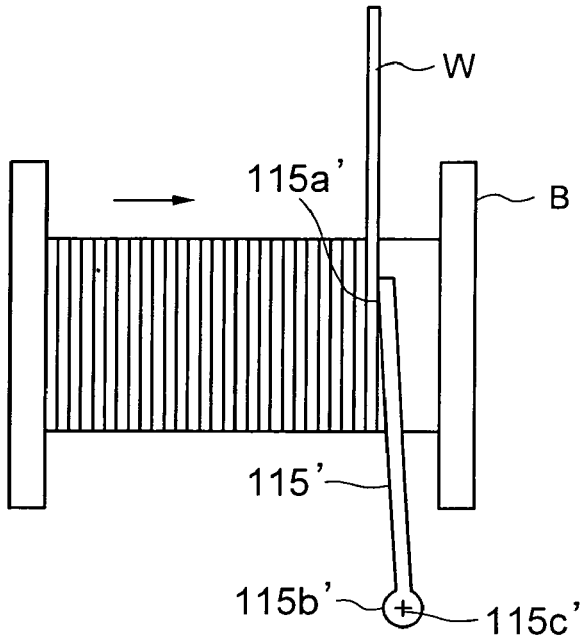
FIGS. 7A to 7B are diagrams illustrating a variation of the present embodiment.
Figure 7B:
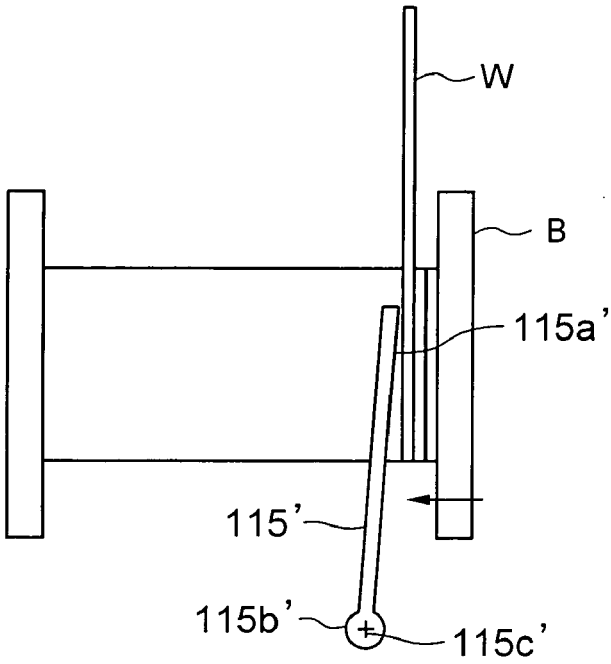

FIGS. 7A to 7B are diagrams illustrating a variation of the present embodiment. Also, in this variation, a guide member 115' and a bobbin B relatively move in synchronism with the rotation of the bobbin B. Suppose that the direction of the arrow is a winding direction in FIG. 7A, a support part 115*b*' of the guide member 115' is supported about a pivot point 115*c*' at an inclined position in a counterclockwise direction in the figure. At this time, the left side surface of a guide part 115*a*' of the guide member 115' in the figure contacts the right side surface of the wire member W, thereby performing the guiding.

Thereafter, when the wound wire member W comes close to the right flange of the bobbin B, the guide member 115' moves from the guide position to the retreat position (upward from the page surface) in order to avoid contacting with the flange, thereby suspending the guiding. Furthermore, as shown in FIG. 7B, the support part 115*b*' of the guide member 115' located at the retreat position moves in the axial direction, also moves to the guide position (downward to the page surface), and further moves to an inclined position in a clockwise direction about the pivot point 115*c*' in the figure by using the time difference while the wire member W is wound to the left flange and then is folded back thereafter. Thereby, the right side surface of the guide part 115*a*' of the guide member 115' in the figure contacts the left side surface of the wire member W wound in the direction of the arrow, and thus the subsequent guiding can be performed.

Figure 8:
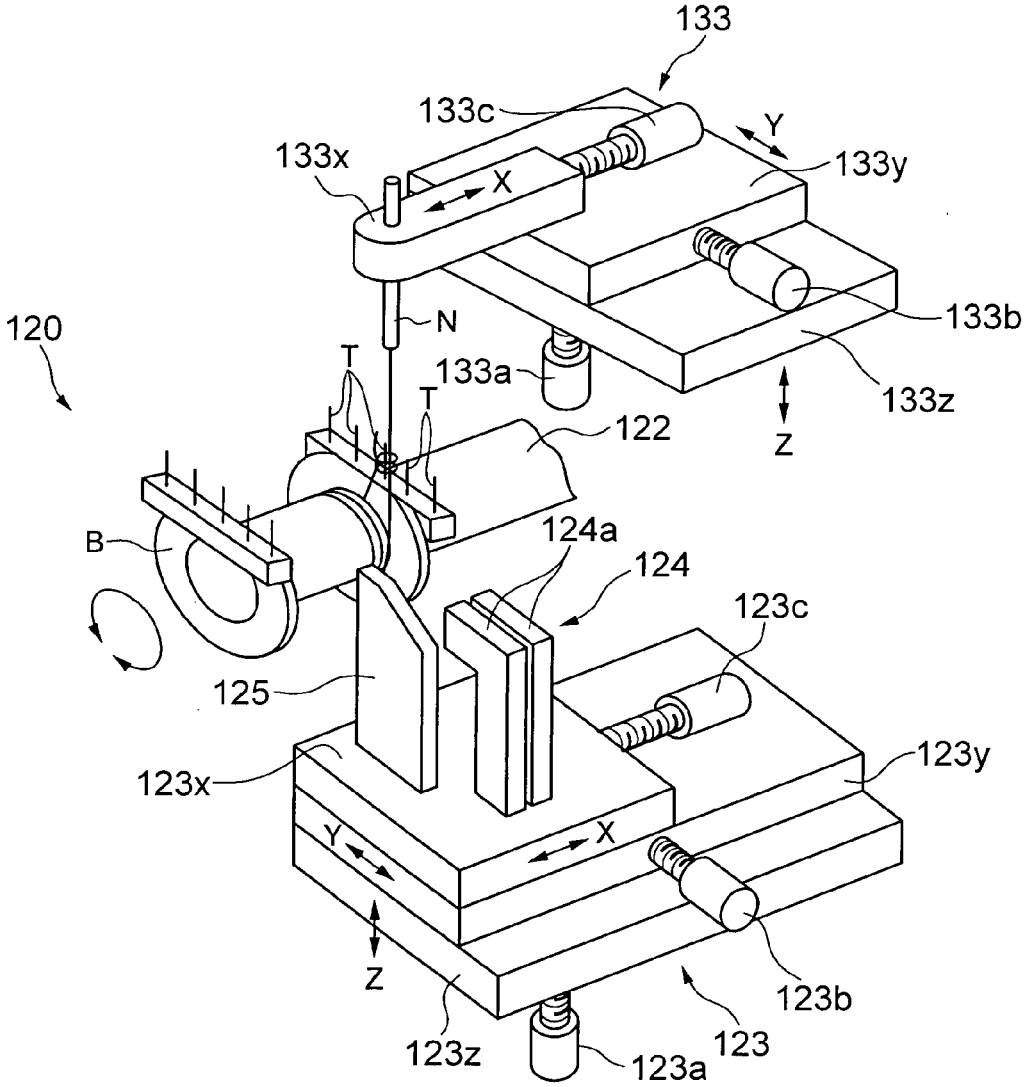
FIG. 8 is a diagram illustrating part of a wire-winding apparatus 120 according to a third embodiment.

FIG. 8 is a diagram illustrating part of a wire-winding apparatus 120 according to a third embodiment. In FIG. 8, the bobbin B is attached to the end of a rotational shaft 122 of an unillustrated motor. However, the rotational shaft 122, which is a (rotational) drive part, does not move in the axial direction. An XYZ movement mechanism 123 is provided close to the rotational shaft 122. The XYZ movement mechanism 123, which is one of drive parts in the axial directions, has a stage 123*z* capable of moving in the Z direction by a motor 123*a*, a stage 123*y* mounted on the stage 123*z* and capable of moving in the Y direction by a motor 123*b*, and a stage 123*x* mounted on the stage 123*y* and capable of moving in the X direction by a motor 123*c*. In this regard, the XYZ movement mechanism 123 is not limited to the configuration shown in the figure.

A cut-and-hold mechanism 124 and a guide member 125 are disposed on the stage 123*x*. The cut-and-hold mechanism 124, which is a holding mechanism, has a pair of gripping parts 124*a*, 124*a* capable of getting closer and separating with each other and an unillustrated cutter, and has a function of holding and cutting the wire member W. The guide member 125 is a knife-shaped plate member formed by metal or ceramic, and has a rigidity higher than the second embodiment. The guide member 125 is independent from the XYZ movement mechanism 123, and is movable in the Z direction by the drive of an unillustrated air cylinder.

At the same time, an XYZ movement mechanism 133, which is another drive part in the axial direction, has a stage 133*z* capable of moving in the Z direction by a motor 133*a*, a stage 133*y* mounted on the stage 133*z* and capable of moving in the Y direction by a motor 133*b*, and an elongated stage 133*x* mounted on the stage 133*y* and capable of moving in the X direction by a motor 133*c*. A nozzle N is attached to the end of the stage 133*x*. In this regard, the XYZ movement mechanism 133 is also not limited to the configuration shown in the figure.

A description will be given of the operation according to the present embodiment. Here, suppose that a wire member W is supplied through a hollow nozzle N driven in three dimensions by the XYZ movement mechanism 133. First, the guide member 125 is moved to a retreat position, and the end of the wire member W supplied from the nozzle N is gripped by the cut-and-hold mechanism 124. After that, the nozzle N moves around any one of terminals T (here, the central) formed on the flange of the bobbin B, thereby performing winding the wire member W around, namely binding to, the terminal T.

Thereafter, the cut-and-hold mechanism 124 releases the wire member W, and the wire member W is wound on the outer periphery surface of the bobbin B by rotating the rotational shaft 122. At this time, the nozzle N and the guide member 125 move to the guide position (inside the diameter of the outer periphery of the flange) shown in FIG. 8. More specifically, the nozzle N is moved in the axial direction using the XYZ movement mechanism 133 in accordance with the number of rotations of the bobbin B, and at the same time, the XYZ movement mechanism 123 is controlled to be synchronized with the rotation of the rotational shaft 122 (moved in the axial direction by the width of the wire member W during one rotation) while holding the left side surface of the wire member W by the right side surface of the guide member 125. Thereby, winding is performed such that the side surface of the wire member W already wound on the outer periphery surface of the bobbin B closely adheres to the side surface of the wire member W about to be wound.

Furthermore, when the wire member W wound on the outer periphery surface of the bobbin B comes close to the left flange, the guide member 125 is moved from the guide position to the retreat position (not shown) more outward in the radial direction in order to avoid contacting the flange. Thereafter, the folded wire member W is captured by the guide member 125 which has moved from the retreat position to the guide position, and the guiding can be subsequently performed in the same manner. In this regard, since the outside diameter of a lower tier and the outside diameter of an upper tier are different, it is desirable to adjust so as to separate the guide member 125 greater distance from the outer periphery surface of the bobbin B as the wire member W is wound in upper tier, thereby restraining the wire member W from being damaged.

When the wire winding is all completed, the nozzle N moves around a terminal T (for example, the endmost) to perform a bind operation. Thereafter, the wire member W output from the nozzle N is cut by the cut-and-hold mechanism 124 to complete the production of the coil.

Figure 9:
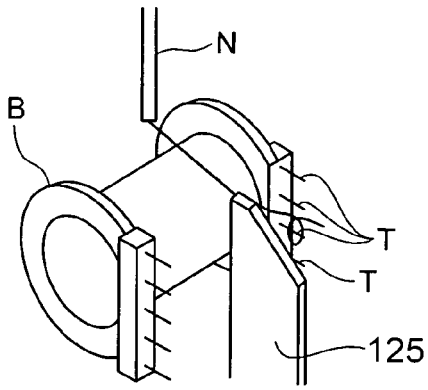
FIG. 9 is a diagram for explaining a function of a guide member 125.

In this regard, the functions of the guide member 125 is not limited to the guide of the wire member W. For example, in the case of winding a wire member W having a high rigidity, after performing the binding operation, the wire member W might swell due to its rigidity to protrude in the center of the bobbin B, thereby disarranging the first winding. In such a case, as shown in FIG. 9, by moving the guide member 125 located at the guide position in the axial direction to push the swollen wire member W on the side surface of the flange of the bobbin B, the initial position of the wire member W is pressed, thereby making it possible to appropriately perform the subsequent winding process.

Figure 10:
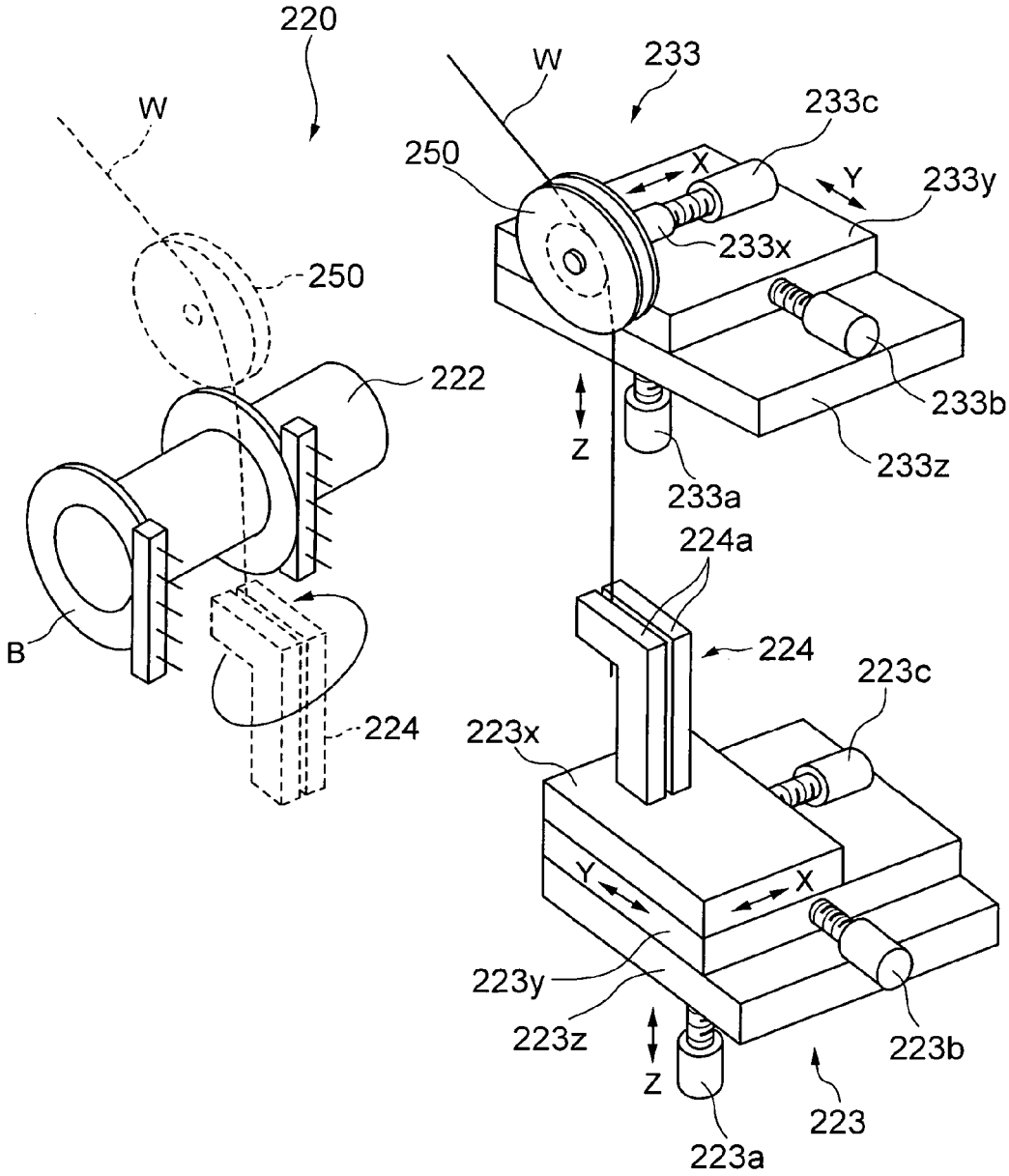
FIG. 10 is a diagram illustrating part of a wire-winding apparatus 120 according to a fourth embodiment.

FIG. 10 is a diagram illustrating part of a wire-winding apparatus 220 according to a fourth embodiment. After a regular-square wire is wound on a bobbin, etc., the end of the wire is bound up and cut, and then new winding is performed on another bobbin. If the end is gripped without any regulation, there might cause disarrangement of the next winding of the wire. The present embodiment can suppress such a problem.

In FIG. 10, the bobbin B is attached to the end of a rotational shaft 222 of an unillustrated motor constituting a rotational drive part. However, the rotational shaft 222 does not move in the axial direction. Furthermore, an XYZ movement mechanism 223 is provided in order to hold a cut-and-hold mechanism 224 and to drive it in three dimensions. The XYZ movement mechanism 223 has a stage 223*z* capable of moving in the Z direction by a motor 223*a*, a stage 223*y* mounted on the stage 223*z* and capable of moving in the Y direction by a motor 223*b*, and a stage 223*x* mounted on the stage 223*y* and capable of moving in the X direction by a motor 223*c*. In this regard, the XYZ movement mechanism 223 is not limited to the configuration shown in the figure. Also, a guide member is omitted in the present embodiment.

At the same time, another XYZ movement mechanism 233 has a stage 233*z* capable of moving in the Z direction by a motor 233*a*, a stage 233*y* mounted on the stage 233*z* and capable of moving in the Y direction by a motor 233*b*, and an shaft 233*x* mounted on the stage 233*y* and capable of moving in the X direction by a motor 233*c*. A pulley 250 is attached to the end of the stage 233*x*. In this regard, the XYZ movement mechanism 233 is also not limited to the configuration shown in the figure. The XYZ movement mechanisms 223 and 233 constitute drive means.

The cut-and-hold mechanism 224, which is a second holding mechanism, has a pair of plate-like gripping parts 224*a*, 224*a* capable of getting closer and separating with each other by the operation of an unillustrated air cylinder and an unillustrated cutter. The cut-and-hold mechanism 224 holds both sides of the regular-square wire member W by the gripping parts 224*a*, 224*a* and has a function of cutting the wire member W.

The pulley 250, which is a first holding means, has a slightly wider width than the wire width of the wire member W and is positioned such that one surface of the wire member W faces to the outside diameter in the state of the wire member W being wound. That is to say, the direction of the side surface of the wire member W supplied from an unillustrated wire source is regulated (held) by passing the pulley 250 and the direction of the side surface thereof is regulated by being held by the cut-and-hold mechanism 224. Accordingly, when the wire member W is held such that both side ends of the wire member W orthogonal to the axis line of the pulley at the time of being wound on the pulley 250 contact in face-to-face relationship with the gripping parts 224*a*, 224*a*, respectively, even if the XYZ movement mechanisms 223 and 233 are independently moved thereafter, the direction of the side surface of the wire member W is maintained. Thus, when the wire member W is wound on the outer periphery surface of the bobbin B, the wire member W will not be disarranged.

A more specific description will be given of the operation of the cut-and-hold mechanism 224. While the wire member W is being wound, the cut-and-hold mechanism 224 does not hold the wire member W. After the winding is completed, the wire member W is gripped between the gripping parts 224*a*, 224*a* therebetween in a state in which tension is placed between the bobbin b and the pulley 250. At this time, both side ends of the wire member W orthogonal to the axis line of the pulley at the time of being wound on the pulley 250 contact in face-to-face relationship with the gripping parts 224*a*, 224*a*, respectively. In such a state, the XYZ movement mechanisms 223 and 233 are operated to fix the wire member W in contact with the corner of the bottom surface of the bobbin B and the inside surface of the flange (at least in a state in which the side surface of the wire member W contacts the inside surface of the flange). In such a state, the direction of the wire member W is kept without change. Thereafter, the XYZ movement mechanisms 223 is independently operated, and the gripping parts 224*a*, 224*a* are rotated and moved around a protrusion (not shown) of the bobbin as shown by an arrow (if a slit is formed on the flange, the wire member W may be put into the slit). By the above operation, the wire member W is wound on the protrusion, and thus the wire member of the bobbin side B is cut by an unillustrated cutter.

Even if the gripping parts 224*a*, 224*a* independently move in this manner, the wire member W is kept in a state of being fixed in contact with the corner of the bottom of the bobbin B and the inside surface of the flange. Thus, the positional relationship with both side surfaces of the wire member W orthogonal to the axis line of the pulley at the time of being wound on the pulley 250 is not changed. Accordingly, it is possible to prevent the disarrangement of the wire member W at winding time even if the binding operation is performed from that state.

In this regard, the pulley 250 and the cut-and-hold mechanism 224 do not necessarily need to be moved integrally, and may be moved separately. Also, the bobbin B may approach the pulley 250 and the cut-and-hold mechanism 224. Furthermore, the first holding means uses a pulley. However, a gripping member such as a cut-and-hold mechanism may grip the wire member.

As described above, the present invention has been described with reference to the embodiments. The present invention, however, should not be construed as being limited to the embodiments described above. The present invention can be properly modified and improved as a matter of course. The present invention can be applied to the case of a wire member having a circular cross section, namely, a circular wire. Note that in the case of a regular-square wire, as shown in FIGS. 4A to 4K, the outer periphery of the wound wire becomes almost a cylindrical surface, and thus the guide becomes necessary for the second tier and after. However, in the case of a circular wire, when a first-tiered wire is arranged, it is possible to regularly wind a second-tiered wire and after using the under-tiered wire as a guide. Thus, the guide of the first-tiered wire becomes important in particular. Furthermore, the present invention can be applied to a so-called multi-spindle wire winding apparatus which performs wire winding on a plurality of bobbins at one time.

The invention claimed is:

1. A wire-winding apparatus for continuously winding a rectangular cross section wire member or a circular cross section wire member on a bobbin or a bobbin-less winding jig, the apparatus comprising:

a rotational drive part for holding and rotating the bobbin or the bobbin-less winding jig; and an axial-direction drive part for moving a first driven member in an axial direction of the bobbin or the bobbin-less winding jib in synchronism with the rotation of the drive part, and three-dimensionally moving a second driven member independently upon the first driven member, wherein the first driven member and the second driven member are brought into contact with the rectangular cross section wire member or the circular cross section wire member.

2. The wire-winding apparatus according to claim 1, wherein the second driven member is a guide member for guiding the rectangular cross section wire member or the circular cross section wire member to wind on an outer periphery of the wound portion of the bobbin or the bobbin-less winding jig.

3. The wire-winding apparatus according to claim 2, further comprising a holding mechanism for holding and cutting the rectangular cross section wire member or the circular cross section wire member, and the guide member moves integrally with the holding mechanism.

4. A wire-winding apparatus comprising:

first holding means for holding a wire source side of a rectangular cross section wire member;

second holding means three-dimensionally moving independently upon the first holding means, for holding an end side of the rectangular cross section wire member;

a rotational drive part for holding and rotating the bobbin or the bobbin-less winding jig; and drive means for moving the first holding means and the second holding means, and the bobbin or the bobbin-less winding jig relatively with each other while maintaining the direction of the rectangular cross section wire member of the wire source side held by the first holding means and the direction of the rectangular cross section wire member of the end side held by the second holding means.

5. The wire-winding apparatus according to claim 4, wherein the second holding means performs a binding operation of the rectangular cross section wire member after the first holding means and the second holding means, and the bobbin or the bobbin-less winding jig are relatively moved and at least one side surface of the rectangular cross section wire member is contacted with the bobbin or the bobbin-less winding jig.

6. The wire-winding apparatus according to claim 4, wherein the second holding means is a cut-and-hold mechanism.

7. The wire-winding apparatus according to claim 4, wherein the first holding means includes a pulley.

* * * * *